US005130173A

United States Patent [19]

Barten et al.

[11] Patent Number: 5,130,173

[45] Date of Patent: Jul. 14, 1992

[54] QUICK DRYING PAINTING METHOD WHERE THE PAINT AND THE OBJECT TO BE PAINTED ARE BOTH PREHEATED

[75] Inventors: Brian L. Barten; Gary A. Halstead, both of Lockport, N.Y.

[73] Assignee: General Motors Corporation, Detroit, Mich.

[21] Appl. No.: 610,621

[22] Filed: Nov. 8, 1990

[51] Int. Cl.[5] ..... B05D 3/00

[52] U.S. Cl. ..... 427/314; 427/372.2; 427/422

[58] Field of Search ..... 427/314, 422, 372.2

[56] References Cited

U.S. PATENT DOCUMENTS

| | | | |
|---|---|---|---|
| 665,747 | 1/1901 | Martin | 427/314 |
| 2,763,575 | 9/1956 | Bede | 427/422 |
| 2,861,897 | 11/1958 | Hendrixson | 427/318 |
| 3,042,547 | 7/1962 | Pickett | 427/314 |
| 3,073,721 | 1/1963 | Pokorny | 427/385 |

*Primary Examiner*—Shrive Beck
*Assistant Examiner*—K. Bareford
*Attorney, Agent, or Firm*—Randy W. Tung

[57] ABSTRACT

A method of painting an object and subsequently drying such painted object by first heating a solvent-containing paint to a temperature between 80° to 115° F. and heating the object to be painted to a temperature between 110° to 160° F. such that the drying time required for the paint after painting is substantially reduced.

3 Claims, 1 Drawing Sheet

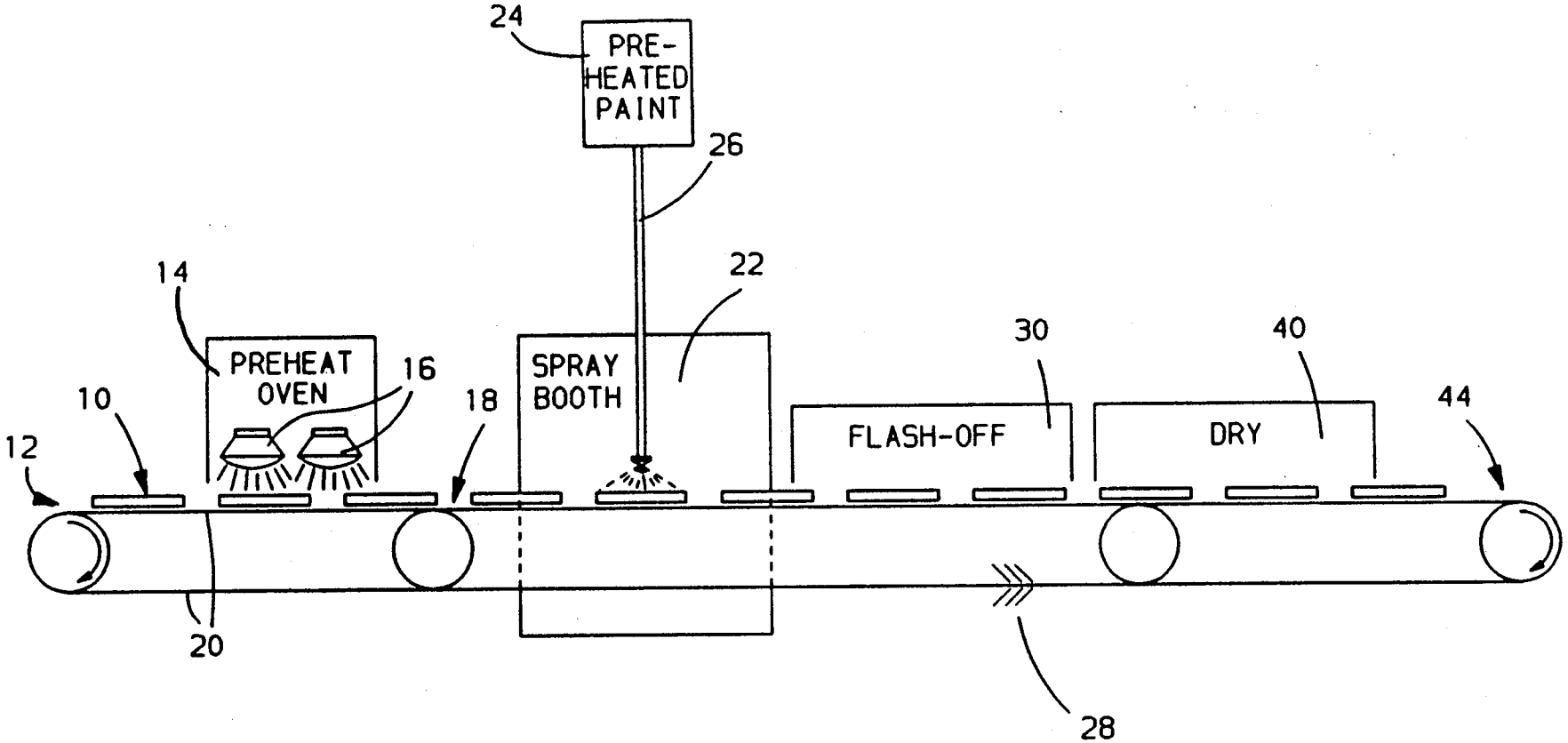
PRE-HEATED PAINT
24
26
22
SPRAY BOOTH
18
16
PREHEAT OVEN
14
10
12
20
FLASH-OFF
30
DRY
40
44
28

QUICK DRYING PAINTING METHOD WHERE THE PAINT AND THE OBJECT TO BE PAINTED ARE BOTH PREHEATED

FIELD OF THE INVENTION

This invention generally relates to a method of painting an object and subsequently drying such painted object and, more particularly, relates to a method of painting an object and subsequently drying such painted object by first heating a solvent containing paint and the object to be painted to a sufficient temperature such that the drying time required for the paint after painting is substantially reduced.

BACKGROUND OF THE INVENTION

In the manufacture of some automotive parts such as radiators and condensers, painting of the part is required for both appearance and corrosion-resistance reasons. In a conventional painting process, these automotive parts are conveyed through a paint spray booth for spray painting with no attempt to preheat the paint or the parts. As a consequence, the drying of these parts normally painted with a water-based paint takes place in a very long drying oven in addition to a 100 feet flash-off station. A length of 300–400 feet of drying oven is frequently required to sufficiently dry these parts.

Lengthy flash-off station and drying ovens are undesirable because they not only occupy extensive floor space area in a manufacturing plant, but also consume enormous amount of energy and require substantial manpower for maintenance. The excessive amount of time necessary to travel through the lengthy flash-off station and drying ovens is also a problem for achieving plant efficiency.

The method of preheating a part prior to its painting process has been utilized in the powder painting technology in which a dry powder paint is deposited on a preheated part such that the heat energy will help to melt and flow the dry powder paint in forming a paint film. The prior art method of preheating the part is, therefore, used for a completely different purpose than that taught by the present invention in that the heat energy in the preheated part is used to melt the powder paint into a paint film.

It is, therefore, an object of the present invention to provide a method of painting objects in which the solvent-containing paint can be quickly dried after the painting process.

It is another object of the present invention to provide a method of painting objects in which the solvent-containing paint can be quickly dried such that a short drying oven can be utilized

SUMMARY OF THE INVENTION

The aforementioned objects can be achieved by the practice of our novel invention in which both the solvent-containing paint and the object to be painted are heated prior to the painting process.

In the practice of our novel invention, the solvent-containing paint of either a water-based paint or an organic solvent-based paint, is first heated to a temperature in the range of 80°–115° F. depending upon the nature of the paint. For water-based paint, a higher temperature is desired. For organic solvent-based paint, higher temperatures should be avoided to prevent the excessive vaporization of the solvent. We have also found that certain paint containing zinc and chrome is especially suited for this purpose.

The objects to be painted also heated to a temperature between 110°–160° F. depending upon the nature of the material of the object. For objects made of materials that are not heat-endurant, such as plastics, the higher temperatures should be avoided to prevent the deformation of the objects.

BRIEF DESCRIPTION OF THE DRAWING

Further objects, features and advantages of the present invention will become apparent from a consideration of the following description, the appended claims, and the accompanying drawing in which an illustration of a typical painting process where the paint and the object to be painted are preheated is shown.

DETAILED DESCRIPTION OF THE PREFERRED EMBODIMENT

In our preferred embodiment as shown in the Figure, a heat exchanger assembly 10 is first loaded onto the conveyer belt 20 at the loading station 12. The conveyer belt 20 then carries the heat exchanger assembly 10 into the preheat oven 14. We have found that a convenient method of heating is by the use of infrared lamps 16 mounted in the preheat oven 14. For a material of lesser heat-endurance, a preheat temperature between 110° F. to 130° F. is preferred. The preheat temperature is measured on the surface of the part. After the heat exchanger assembly 10 exits the preheat oven 14, it is carried on the conveyer belt 20 into a transfer section 18 of the painting process. The transfer section 18 is necessary such that the spray booth 22 and the preheat oven 14 are sufficiently separated for safety reasons. Preheated paint 24 transported through paint tube 26 into spray booth 22 is then sprayed onto the heated surface of heat exchanger 10.

For water based paint, we have found that a desirable preheat temperature for the paint is between 80°–115° F. to achieve the quick drying effect. At a temperature lower than 80° F., the paint film thickness achieved is less and a wet paint film after drying is frequently observed. At a temperature higher than 115° F., a rapid loss of water in the water-based paint would occur to deteriorate the paint. For other paints such as the organic solvent-based paint, a lower preheat temperature between 80°–100° F. may be desirable to avoid the excessive loss of solvent. The paint is sprayed with normal industrial standard spraying techniques.

After the paint spray booth 22, the heat exchanger assembly 10 is carried by conveyer belt 20 into a flash off station 30. In the flash off station 30 the higher volatile content of the paint is evaporated off at ambient temperature. The heat exchanger assembly 10 is then carried by the conveyer belt 20 into the drying oven 40 for the final drying process. We have found that for a heat exchanger assembly preheated to 110°–160° F., painted with a preheated paint of 80°–115° F., and conveyed at a conveyer belt speed of 6 feet per minute, a sixteen feet long drying oven is sufficient to substantially dry the paint.

The heat exchanger assembly 10, after drying oven 40, is then unloaded at unload station 44 at the end of the conveyer belt 20.

Our novel invention demonstrated that, in the case of a heat exchanger assembly, the paint drying oven that is sufficient to substantially dry the paint is shortened from 300 feet to a length of 16 feet. This drastic reduction in the length of drying oven required produces substantial savings not only in the floor space required for the oven, but the energy consumption and the manpower necessary to maintain the ovens. Our novel invention, therefore, produces a significantly improved result than the conventional drying method.

The embodiments of the invention in which an exclusive property or privilege is claimed are defined as follows:

1. In a method of painting an object with a solvent-containing paint and quickly drying said paint, the improvement comprising the steps of preheating said solvent-containing paint to a temperature between 80° to 115° F. and preheating said object to a temperature between 110° to 160° F., wherein said temperatures are higher than room temperature but substantially below the boiling temperature of said solvent in said solvent-containing paint.

2. A method of quick drying a solvent-containing paint on a painted object such that only a limited length of drying oven is necessary to dry such paint comprising the steps of:

preheating said solvent-containing paint to a temperature between 80° to 115° F., preheating an object to be painted to a temperature between 110° to 160° F., wherein said temperatures are higher than room temperature but substantially below the boiling temperature of said solvent in said solvent-containing paint, applying said preheated paint onto said object, and passing said painted object through a drying oven such that said solvent-containing paint is substantially dried.

3. In the method of claim 2, said solvent-containing paint further contains zinc and chromium.

* * * * *